United States Patent [19]

Guerrero et al.

[11] 4,339,889

[45] Jul. 20, 1982

[54] MULTIPLE FUNCTION DOLL

[75] Inventors: Benjamin G. Guerrero, Los Angeles; Diana C. Troup, Cerritos; Peter C. White, Rancho Palos Verdes, all of Calif.

[73] Assignee: Mattel, Inc., Hawthorne, Calif.

[21] Appl. No.: 117,746

[22] Filed: Feb. 1, 1980

[51] Int. Cl.[3] ..... A63H 11/00

[52] U.S. Cl. ..... 46/135 A; 46/120

[58] Field of Search ..... 46/92, 126, 135 A, 141, 46/264, 265, 268, 120

[56] References Cited

U.S. PATENT DOCUMENTS

| | | | |
|---|---|---|---|
| 2,504,811 | 4/1950 | Davis et al. | 46/264 X |
| 2,611,996 | 9/1952 | Garelick | 46/92 |
| 2,854,787 | 10/1958 | Oberg | 46/92 |
| 2,961,795 | 11/1960 | Baggott | 46/135 A |
| 3,154,881 | 11/1964 | Elwell | 46/264 X |
| 3,164,924 | 1/1965 | Iwaya et al. | 46/264 X |
| 3,444,645 | 5/1969 | Tepper et al. | 46/135 A |
| 3,769,745 | 11/1973 | Crosman | 46/135 A |
| 3,846,934 | 11/1974 | Thorn et al. | 46/264 X |

FOREIGN PATENT DOCUMENTS

| | | | |
|---|---|---|---|
| 494171 | 7/1953 | Canada | 46/126 |
| 2059236 | 6/1971 | Fed. Rep. of Germany | 46/135 A |
| 1432598 | 4/1976 | United Kingdom | 46/92 |
| 2013092 | 8/1979 | United Kingdom | 46/92 |

*Primary Examiner*—F. Barry Shay
*Attorney, Agent, or Firm*—Reagin & King

[57] ABSTRACT

A multiple function doll having a unitary drop-in internal mechanism including a motor which rotates a cam to cause an arm of the doll to wave and rotates a drive shaft to reciprocate a pump which causes the doll to tear. The simplified mechanism is constructed to provide conduits for liquid from the doll's mouth to a reservoir and from the reservoir to the doll's eyes so that internal tubing is eliminated. The elimination of tubing and reduction of components reduces substantially the tendency of the doll to failure.

7 Claims, 6 Drawing Figures

10
32
26
87
28
27
27
14
16
30
18
12
24
25
20
34
22

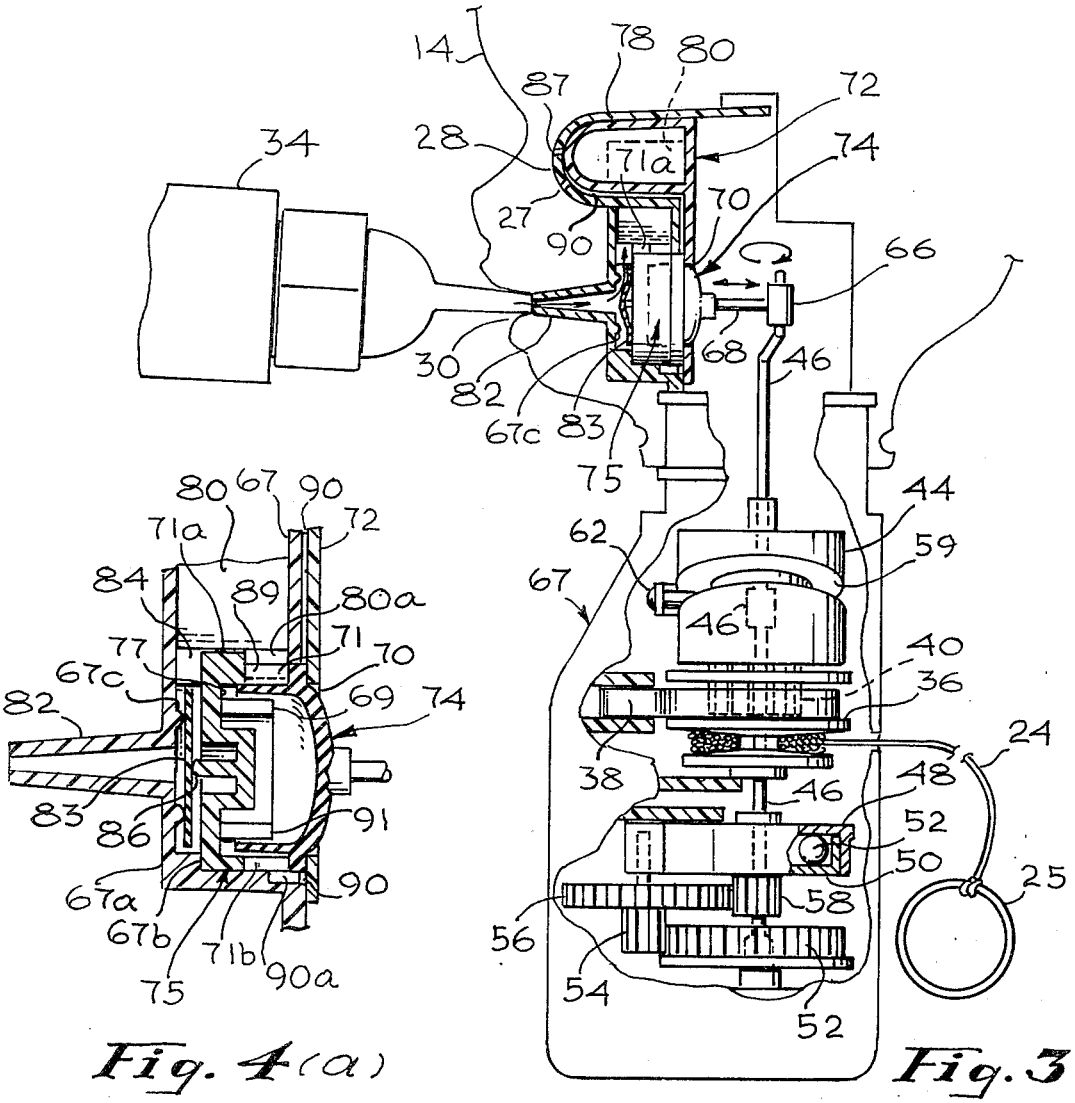
Fig. 3
Fig. 4(a)
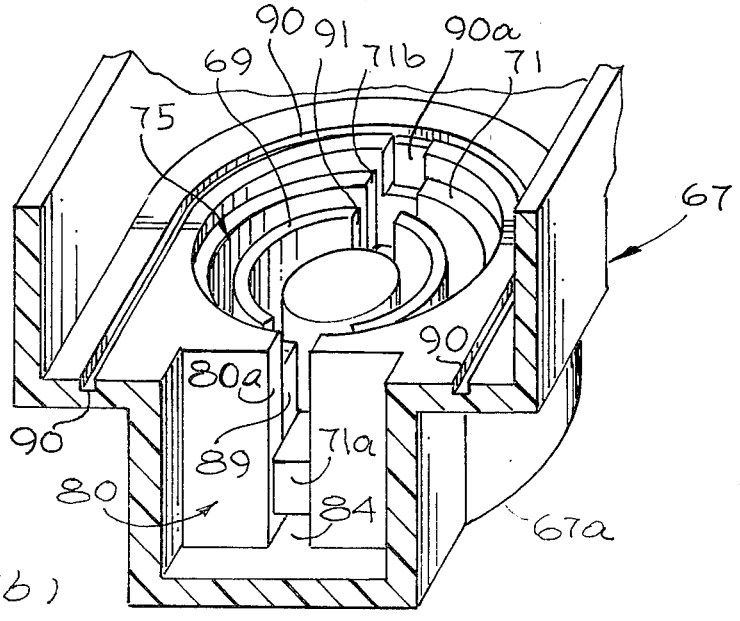
Fig. 2(b)

MULTIPLE FUNCTION DOLL

BACKGROUND OF THE INVENTION

This invention relates to dolls and, more particularly, to improved dolls capable of performing a number of functions.

There have been many dolls devised by the inventors of the prior art. A number of such dolls have been provided with mechanisms which allow them to simulate various functions of a child such as crying. Most such crying dolls have mechanisms which are operated by a hand pump. Two such dolls are shown in Ryan et al U.S. Pat. No. 3,445,955 issued May 27, 1969, and Terzian U.S. Pat. No. 4,057,928 issued Nov. 15, 1977. Even though hand operated, the mechanisms of such dolls are usually quite complicated. Such crying dolls often utilize extensive tubing paths within the body which are subject to failure and consequent failure of the mechanism. When such crying dolls are mechanized to perform additional activities, the mechanism becomes so complicated that the doll must be large and bulky. Such dolls are often made of materials which are suited only for the special mechanical needs and which make the dolls expensive and unattractive to a child. Certain of such dolls may be used only as crying dolls. Dolls which are capable of accomplishing functions in addition to crying are often constructed to utilize a number of different mechanical arrangements for each of the individual operations. Tepper et al U.S. Pat. No. 3,444,645, issued May 20, 1969, and the Ryan et al patent, above-mentioned, are examples of such multiple function dolls.

It is an object of the present invention to provide an improved multi-function mechanism for a toy doll.

It is another object of this invention to provide an improved mechanism which is capable of accomplishing a number of functions in a toy doll.

It is an additional object of this invention to provide a multiple function toy doll having a simplified mechanism which reduces the tendency of such a doll to malfunction.

It is yet another object of this invention to provide a multiple function toy doll which is capable of use by a child, when not being used to accomplish any of the multiple functions, as is a normal toy doll.

SUMMARY OF THE INVENTION

The foregoing and other objects of the invention are accomplished by a toy doll which has a simplified mechanism including a motor positioned within the body of the doll adapted to drive a rotating mechanism which provides output both to cause an arm of the doll to wave and to operate a pump to provide simulated tears. The pumping and tearing mechanism is so constructed that no tubing is necessary, and extremely strong interior construction eliminates most possibilities for failure of the doll in use. The mechanism is sufficiently compact that it may be placed within the body of a relatively small doll and that body may be constructed of materials used in the construction of a normal baby doll. In a preferred embodiment, the body of the doll is constructed of cloth so that the doll may be placed with as are normal baby dolls.

Other objects, features, and advantages of the invention will become apparent from a reading of the specification when taken in conjunction with the drawings in which like reference numerals refer to like elements in the several views.

BRIEF DESCRIPTION OF THE DRAWINGS

FIG. 2(*a*) is a perspective view, partially in cross section, showing the asembled parts of the doll, including a pump and a lid employed in the construction of the doll, as viewed along the line 2(*a*)—2(*a*) in FIG. 2;

FIG. 2(*b*) is a perspective view, partially in cross section, as viewed along the line 2(*b*)—2(*b*) in FIG. 2, rotated one hundred eighty degrees to more clearly show the interface between a retainer and the body of the doll;

FIG. 4(*b*) is a view of a portion of the detail of FIG. 4(*a*); and

DESCRIPTION OF THE PREFERRED EMBODIMENT

Figure 1:
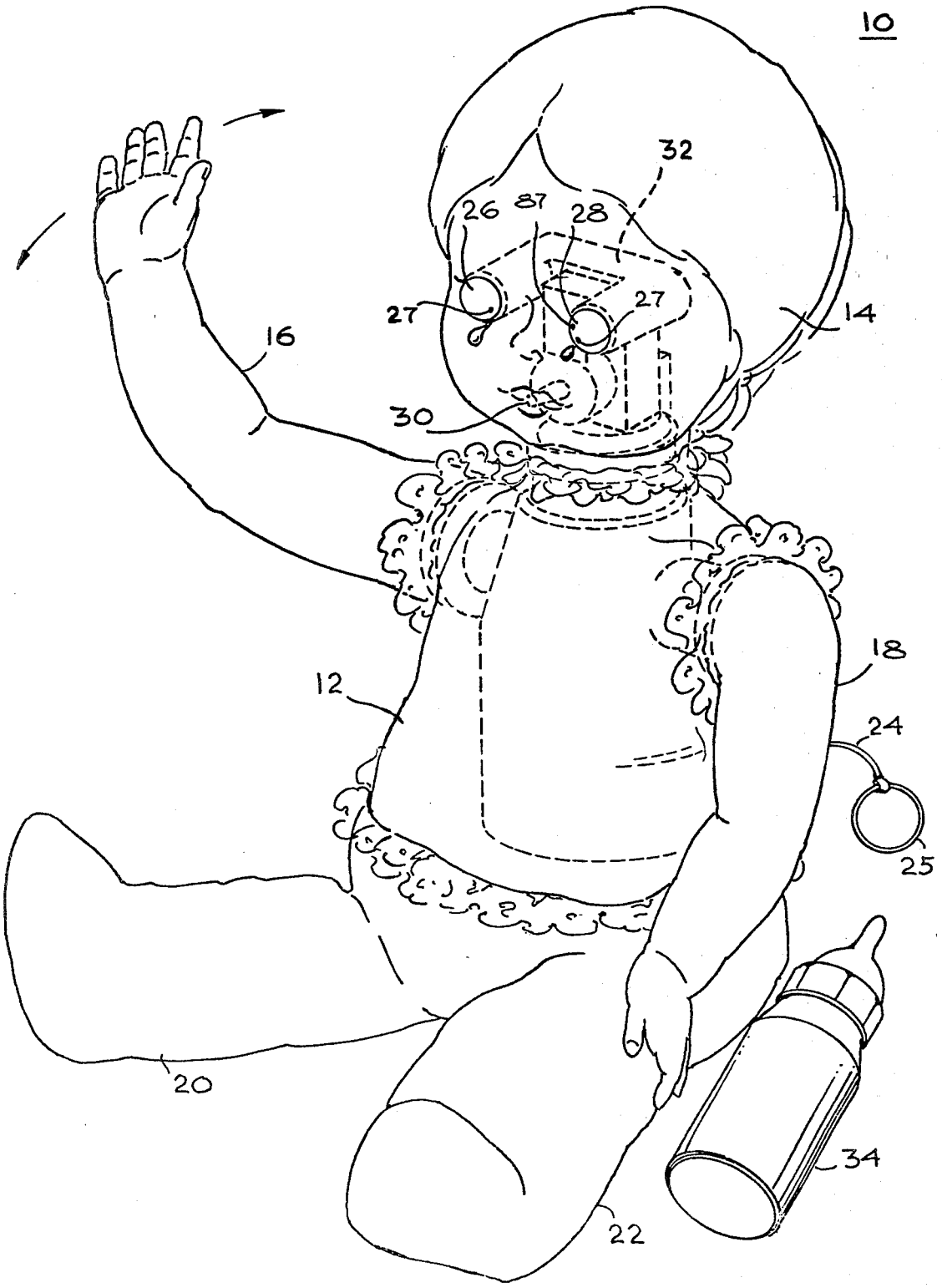
FIG. 1 is a perspective view of a baby doll constructed in accordance with the invention.

Referring now to the drawings and, more particularly, to FIG. 1, there is shown a toy doll 10 constructed in accordance with the invention. The doll 10 has a body 12 which may be constructed of a soft cloth material in a preferred embodiment. The body 12 supports a head 14, a pair of arms 16 and 18, and a pair of legs 20 and 22. Projecting from the rear of the body 12 is a pull string 24 connected to a ring 25.

The head 14 of the doll has a pair of eyes 26 and 28 and a mouth 30 as well as other features which are not important to the understanding of this invention. The eyes 26 and 28 and the mouth 30 are each connected to a mechanism 32 (shown in dotted lines in FIG. 1) which when operated causes the eyes 26 and 28 of the doll to tear through openings 27 and the arm 16 to wave. The mouth 30 provides an orifice through which water or other fluid may pass from a bottle 34.

The small size of the mechanism 32 illustrated in FIG. 1 relative to the mechanism usually required for operating a multifunction doll should be noted. The small size of the mechanism allows a small doll body. Further, the construction of the mechanism is such that, as will be shown hereinafter, the doll 10 may be constructed of a material such as soft cloth which a child finds pleasant to play with. Since the mechanism 32 occupies a central position in the doll 10, the doll 10 need not have its extremities other than the head 14 and the arm 16 constructed in any particular manner of any particular material.

Figure 2:
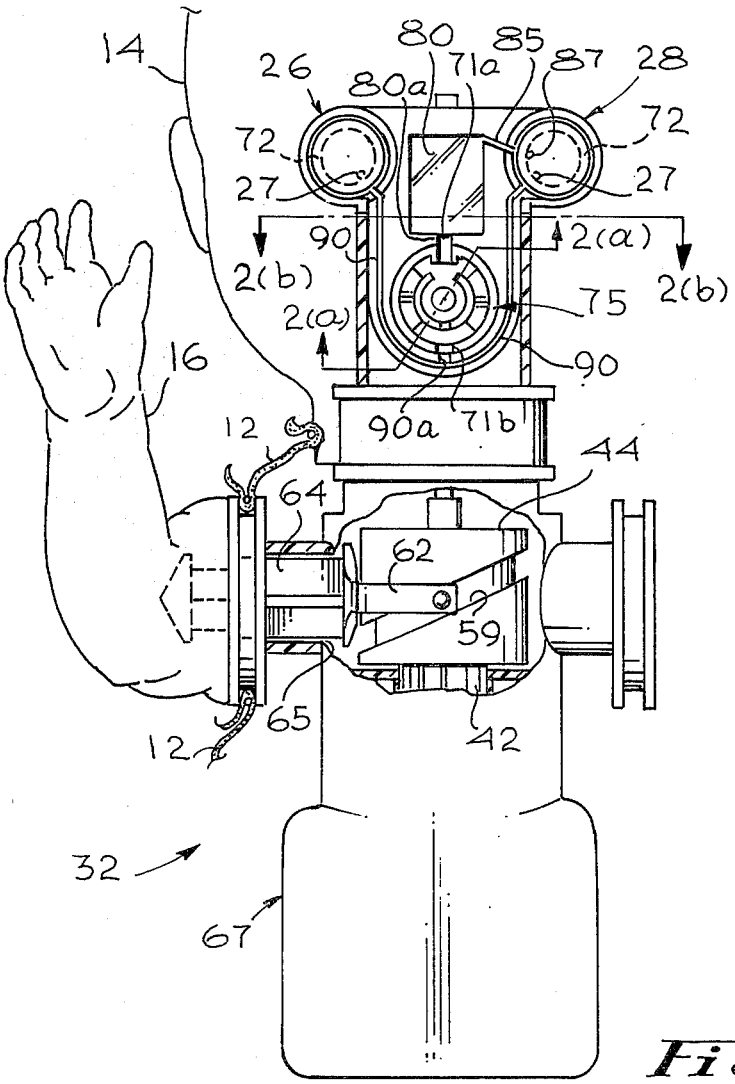
FIG. 2 is a front view, partially cut away and partially in cross section, of the internal mechanism of the baby doll shown in FIG. 1.
Figure 3:
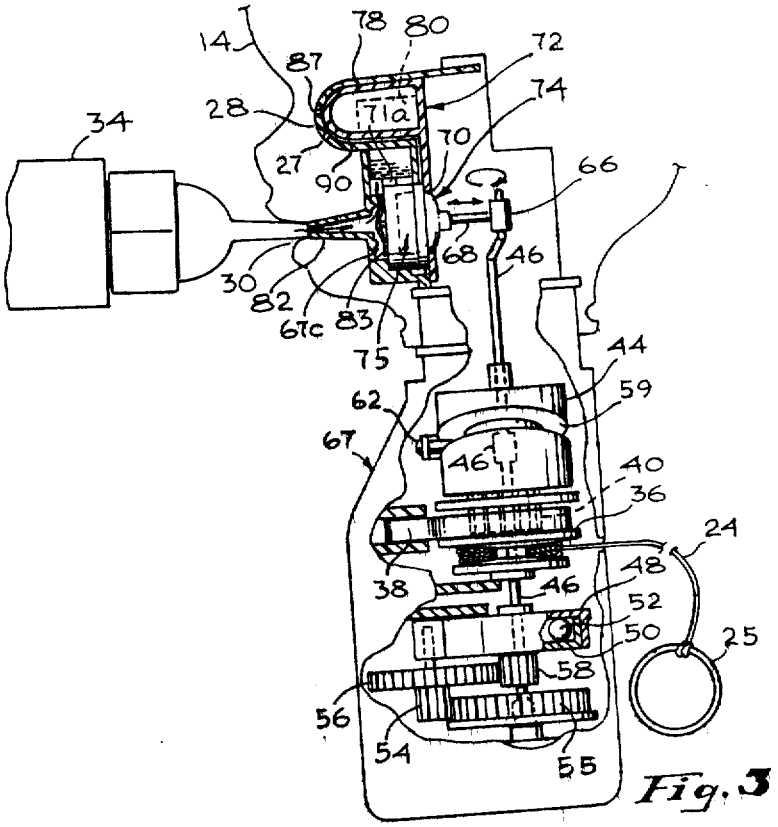
FIG. 3 is a side view, partially cut away and partially in cross section, of the internal mechanism of the baby doll shown in FIG. 1.
Figure 5:
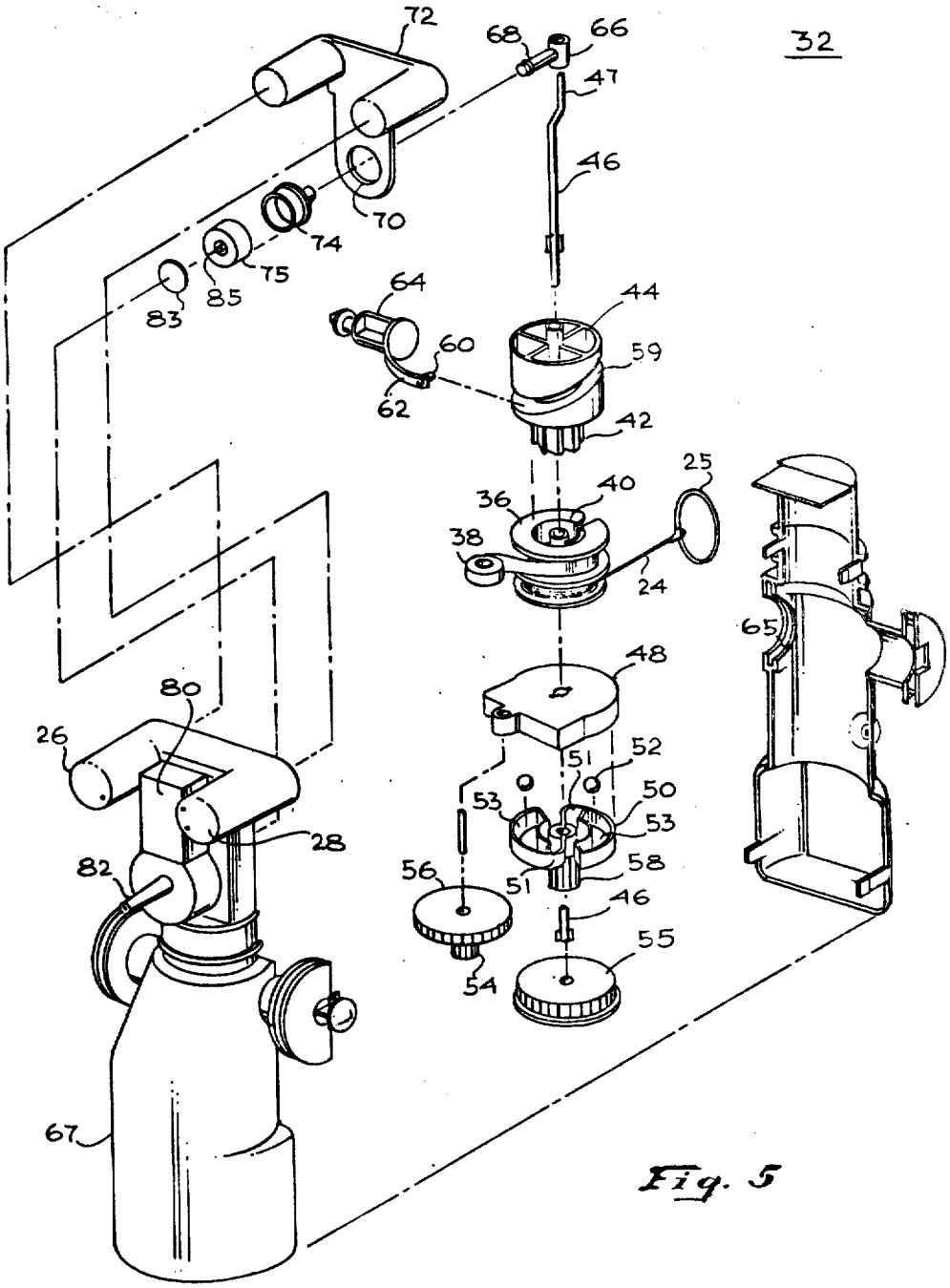
FIG. 5 is an exploded perspective view of the internal mechanism shown in FIGS. 2 and 3.

Referring now to FIGS. 2, 3, and 5, there are shown front, side, and exploded perspective views of the mechanism 32. As may be seen, when the ring 25 is pulled, the string 24 is withdrawn from the body 12 of the doll 10 causing the rotation of a spool 36 to which is affixed a negator spring 38. A free end of the spring 38 within an upwardly-facing cylindrical cavity in the spool 36 bears against a cylindrical gear-faced rachet surface 42 which projects into the cavity of the spool 36 from the lower surface of a rotating cam 44. The free end of spring 38 rotates freely in one direction but will not move in the other against the gear surface 42 when the string 24 is withdrawn from the body 12 of the doll 10. Consequently, withdrawal of the string 24 unwinds spring 38; and when the ring 25 and the string 24 are released, the spring 38 rotates the spool 36 and the cam 44 and drives an inner drive shaft 46 coaxially affixed thereto. The drive shaft 46 projects downwardly and moves freely through a governor consisting of a housing 48, a rotating mechanism 50, and a pair of weights 52. The shaft 46 is fixed at its lower end to a gear 52 which rotates a spur gear 54. The spur gear 54 drives an idler gear 56 attached thereto to rotate a spur gear 58 projecting from and attached to rotating mechanism 50. The mechanism 50 is molded of a relatively soft plastic and has thin sections 51 connecting outer chambers 53 to its axis. The rotation of the mechanism 50 within the housing 48 causes the balls 52 to spin to an outer position where the exterior surface of the chambers 53 bears against the interior of the housing 48 exerting friction thereby maintaining the top speed of rotation of the governor and the shaft 46 below a particular limit.

The rotation of the cam 44 causes a groove 59 which encircles the outer circumference of the cam 44 to move a finger 60 affixed to an arm 62 projecting from an arm lever 64. The arm lever 64 projects through the doll body 12 and is fixed to the arm 16 so that as the finger 60 moves in the groove 59, the arm 16 is caused to move in a waving motion as is illustrated in FIG. 1. As may be seen in FIG. 2, the arm lever 64 is held to rotate in an aperture 65 in the external body 67 of the mechanism 32.

The shaft 46 is offset at its upper end to form a crank shaft 47, the rotation of which describes a circular movement. The shaft 47 fits freely through an aperture in an actuator 66 which has an arm 68 projecting through an aperture 70 in a lid 72 to drive a pump 74. The rotation of the shaft 46 moves the actuator 66 in a small circle, and an arm 68 projecting from the actuator 66 translates the rotation into reciprocating movement of the pump 74. The pump 74 (which may be molded of a soft vinyl material) is a hollow cylinder open at one end; the open end fits in a recess in a retainer 75 which is held within a cylindrical recess 67*a* (see FIGS. 2(*a*) and 5) in the interior of the body or housing 67 of the mechanism 32 and abuts against a shoulder 67*b* therein. The recess is formed between outwardly projecting cylindrical walls 69 and 71 molded as a part of the retainer 75. The open end of the cylinder of the pump 74 abuts against a raised surface 73 of the retainer 75 which surface projects upward in FIG. 2(*a*) above a surface 77. As shown in FIGS. 2(*a*) and 4(*a*), the pump 74 and the retainer 75 are held in place by the rim of the aperture 70.

The upper portion of the housing 67 has the eyes 26 and 28 of the doll 10 formed therein on extensions 78 which project outwardly toward the front of the doll 10 and have a hollow cylindrical interior. The extensions 78 are separated by a molded reservoir 80 having a slotted opening 80*a* as shown in FIGS. 2 and 2(*b*) and which receives the liquid transferred from the bottle 34 through the mouth 30 of the doll 10.

Figure 4B:
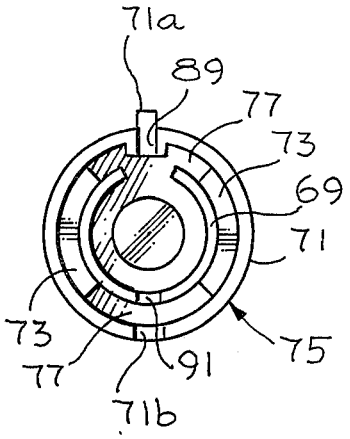
FIG. 4(*a*) is an enlarged side view of a detail of the internal mechanism shown in FIGS. 2 and 3.
Figure 2A:
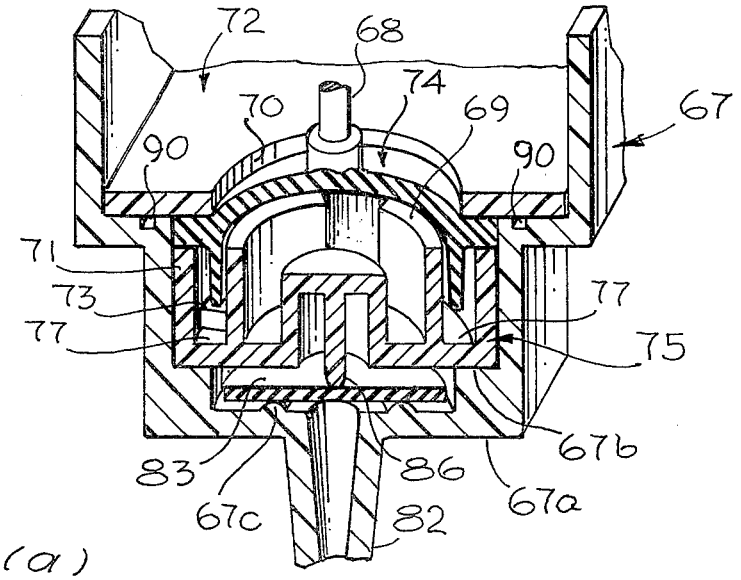

As is better illustrated in FIG. 3, liquid in the bottle 34 is directed to the mouth 30 of the doll 10 and flows into a projecting orifice 82. The liquid proceeds through a channel in the orifice 82 under slight pressure from the bottle 34 and presses against and opens a check valve 83 as shown in FIG. 3 to enter a path 84 open to the reservoir 80. The check valve 83 is held in place by an end 86 projecting to the left in FIG. 4 from the retainer 75, and forms a seal by resting against annular lip 67*c* as shown in FIGS. 2(*a*) and 4(*a*). The liquid proceeds along the path 84 into the interior of the reservoir 80. The path 84 is defined by the intersection of molded parts (which may be constructed of a material such as high impact styrene) including the housing 67 and the surface of a projection 71*a* of the retainer 75 as shown in FIGS. 2(*b*) and 4(*a*). The water flows freely through the path 84 because of the openings 87 and 27 in the eyes 28 and 26 which relieves pressure which might otherwise build up within the reservoir 80. The reservoir 80 has a liquid path 85 leading to the opening 87 at the inner portion of the eye 28 from which liquid leaks to indicate when the reservoir is full. Consequently, a child may feed the baby water or other liquid until the reservoir 80 is filled and will know when to remove the bottle 34.

When the ring 26 is pulled to withdraw the string 24 from the body of the doll 10 and the spring motor is actuated to rotate the shaft 46, the actuator 66 will be driven in a reciprocal motion to cause the flexible pump 74 to reciprocate. The motion of withdrawal of pump 74 from the retainer 75 will withdraw water from the reservoir 80 and pull that water through an opening 89 in the upper side of the wall 71 into the interior of the pump 74 via the recessed surface 77. As may be seen, the soft vinyl of the cylindrical wall of the pump 74 flexes inwardly with the withdrawal stroke to open the opening 89. The motion of the pump 74 in the opposite direction closes the opening 89, flexes the lower cylindrical wall of the pump 74 to force water through an aperture 91 in the bottom of the wall 69 and via an opening 71*b* in the wall 71 adjacent the lower portion of the recessed surface 77 into a groove 90 (are FIGS. 2 and (*b*)) leading to openings 27 in the lower inside corners of each of the two eyes 26 and 28 so that the doll 10 will appear to shed tears. The groove 90, which includes a stepped passageway 90*a* leading to the opening 71*b*, is formed on the interior surface of the housing 67 and is closed to form a fluid path by the inner surface of the lid 72 as shown in FIGS. 2(*a*) and 3. As may be seen, this will take place while the doll is waving its arm "goodby" to its playmate.

The unique configuration of the pumping mechanism by which all of the tubing normally used within a crying doll is eliminated should be carefully noted. The entire mechanism 32, as may be understood from the foregoing description and the figures, is quite small relative to mechanisms which have been previously devised. The mechanism 32 is formed as a single internal element which drops into the doll 10. Furthermore, it includes only a very small number of moving parts which cooperate to provide a multiplicity of different operating functions. Thus, the mechanism 32 of the doll 10 is much less likely to fail than are mechanisms of the prior art. The mechanism 32 of the present invention is quite inexpensive to construct. For example, the interior portions of the mechanisms 32 are made of various moldable plastics which may be easily shaped by those skilled in the art to form the portions which allow the reduction in size and complication of the mechanism 32.

Thus, though there has been shown and described a preferred embodiment of the invention, it is to be understood that various other adaptations and modifications may be made by those skilled in the art without departing from the spirit and scope of the invention.

What is claimed is:

1. A doll comprising a body; a limb mounted to the body; a head having eyes supported by the body; and an operating mechanism positioned in the body including a motor, a cam driven by said motor, means linking the cam to the limb whereby the limb is moved by the operation of the motor, a drive shaft driven by the cam, a reservoir for liquid, means for conducting the liquid from the reservoir to an exit opening adjacent the eyes, and a pump connected to be operated by the driven shaft to move liquid from the reservoir through the conducting means to the exit opening.

2. A doll as claimed in claim 1 in which the operating mechanism further comprises a housing defining liquid conduits from the exterior of the head to the reservoir, from the reservoir to the pump, and from the pump to the eyes.

3. A doll operating mechanism comprising a motor, a shaft driven by the motor, an offset crank driven by the shaft, a cam surface driven by the motor, means connected to the cam surface for providing reciprocating circular motion, pump means connected to the crank for moving liquid, and a housing shaped to define a reservoir and to define conduits from the reservoir to the exterior of the mechanism, from the reservoir to the pump means and from the pump means to the exterior of the mechanism, the housing being further shaped to define eyes for a doll where the conduits from the pump means emerge to the exterior of the mechanism.

4. A doll operating mechanism as claimed in claim 3 wherein the cam surface comprises a groove cut in an outer face of a cylinder which is rotated about its axis.

5. A doll operating mechanism as claimed in claim 4 wherein the means connected to the cam surface for providing reciprocating circular motion comprises an arm mounted to rotate adjacent the cam surface, and a finger attached to the arm riding in the groove.

6. A doll operating mechanism as claimed in claim 3 wherein the housing is shaped to define an orifice for a mouth of a doll where the conduit from the reservoir emerges to the exterior of the mechanism.

7. A doll operating mechanism as claimed in claim 3 wherein the pump means comprises an actuator rotatably connected to the offset crank, a flexible diaphragm connected to the actuator, and a hollow cavity mounting the diaphragm.

* * * * *

UNITED STATES PATENT AND TRADEMARK OFFICE

CERTIFICATE OF CORRECTION

PATENT NO. : 4,339,889

DATED : July 20, 1982

INVENTOR(S) : Benjamin G. Guerrero et al.

It is certified that error appears in the above-identified patent and that said Letters Patent is hereby corrected as shown below:

Column 3, line 12, "gear 52" should read -- gear 55 --.

Sheet 3, Figure 3, should appear as shown on the attached sheet.

Figure 5 has been added to appear as shown on the attached sheet.

On the title page, "7 Claims, 6 Drawing Figures" should read -- 7 Claims, 8 Drawing Figures --.

Signed and Sealed this

*Eleventh* Day of *October 1983*

[SEAL]

*Attest:*

GERALD J. MOSSINGHOFF

*Attesting Officer*

*Commissioner of Patents and Trademarks*

Patent No. 4,339,889

July 20, 1982

Benjamin G. Guerrero et al.

Patent No. 4,339,889 July 20, 1982

Benjamin G. Guerrero et al.